US007350620B2

(12) United States Patent
Lalonde

(10) Patent No.: US 7,350,620 B2
(45) Date of Patent: Apr. 1, 2008

(54) COMPACT SILENCER

(76) Inventor: Sylvain Lalonde, 763, Haute-Rive Avenue, Bois-des-Filions, Quebec (CA) J4P 2H8

( * ) Notice: Subject to any disclaimer, the term of this patent is extended or adjusted under 35 U.S.C. 154(b) by 128 days.

(21) Appl. No.: 11/066,427

(22) Filed: Feb. 28, 2005

(65) Prior Publication Data

US 2005/0194208 A1 Sep. 8, 2005

(51) Int. Cl.

| | |
|---|---|
| ***F01N 1/08*** | (2006.01) |
| ***F01N 1/10*** | (2006.01) |
| *F01N 1/02* | (2006.01) |
| *F01N 1/04* | (2006.01) |
| *F01N 1/24* | (2006.01) |

(52) U.S. Cl. ..... 181/270; 181/269; 181/274; 181/279; 181/281; 181/256

(58) Field of Classification Search ..... 181/269, 181/270, 274, 279, 280, 281, 252, 255, 249, 181/256

See application file for complete search history.

(56) References Cited

U.S. PATENT DOCUMENTS

| | | | | | |
|---|---|---|---|---|---|
| 2,115,128 | A | * | 4/1938 | Starkweather et al. | 181/269 |
| 2,205,899 | A | * | 6/1940 | Chipley | 181/269 |
| 2,651,381 | A | * | 9/1953 | Cooper | 181/281 |
| 3,132,717 | A | * | 5/1964 | Baruch | 181/256 |
| 3,154,388 | A | * | 10/1964 | Purse | 422/179 |
| 3,235,003 | A | * | 2/1966 | Smith | 165/135 |
| 3,633,343 | A | * | 1/1972 | Mark | 96/118 |
| 3,851,727 | A | * | 12/1974 | Getz et al. | 181/256 |
| 3,957,133 | A | * | 5/1976 | Johnson | 181/256 |
| 3,966,443 | A | * | 6/1976 | Okano et al. | 55/337 |
| 4,109,753 | A | * | 8/1978 | Lyman | 181/252 |
| 4,129,196 | A | * | 12/1978 | Everett | 181/280 |
| 4,222,456 | A | * | 9/1980 | Kasper | 181/296 |
| 4,325,459 | A | * | 4/1982 | Martin | 181/248 |
| 4,372,421 | A | * | 2/1983 | Jackson | 181/243 |
| 4,595,073 | A | * | 6/1986 | Thawani | 181/265 |
| 4,682,470 | A | * | 7/1987 | Shaff | 60/299 |
| 4,981,368 | A | * | 1/1991 | Smith | 366/337 |
| 5,058,704 | A | * | 10/1991 | Yu | 181/262 |
| 5,109,950 | A | * | 5/1992 | Lescher | 181/256 |
| 5,703,338 | A | * | 12/1997 | Liese | 181/264 |
| 5,916,134 | A | * | 6/1999 | Yang et al. | 60/299 |
| 6,089,348 | A | * | 7/2000 | Bokor | 181/272 |

(Continued)

FOREIGN PATENT DOCUMENTS

CA 2147209 A1 10/1995

(Continued)

*Primary Examiner*—Edgardo San Martin
(74) *Attorney, Agent, or Firm*—Paul Marcoux

(57) ABSTRACT

There is disclosed a silencer for attenuating sound waves produced in a fluid that circulates through a fluid conveyer. The silencer comprises an expansion chamber that is in fluid communication with the fluid conveyer, and which carries sound waves there through; a sound wave dissipater provided with the expansion chamber and arranged to absorb sound waves traveling there through; a resonator operatively associated with the sound wave dissipater and constructed and arranged to cause attenuation and reflection of the sound waves back and forth towards the sound wave dissipater; the expansion chamber having a chamber: conveyer cross-sectional area ratio and chamber length characteristics allowing maximum transmission loss for a given frequency. The expansion chamber has an exit to allow fluid containing attenuated sound waves to escape therefrom.

11 Claims, 2 Drawing Sheets

U.S. PATENT DOCUMENTS

| | | | | |
|---|---|---|---|---|
| 6,283,246 | B1 * | 9/2001 | Nishikawa | 181/255 |
| 6,343,673 | B1 * | 2/2002 | Chang | 181/227 |
| 6,385,967 | B1 * | 5/2002 | Chen | 60/312 |
| 6,554,100 | B2 * | 4/2003 | Kim | 181/279 |
| 6,588,545 | B1 * | 7/2003 | Lee | 181/264 |
| 6,629,580 | B2 * | 10/2003 | Nilsson et al. | 181/265 |
| 2005/0126850 | A1 * | 6/2005 | Yamaguchi et al. | 181/249 |
| 2006/0076185 | A1 * | 4/2006 | Arlasky | 181/279 |

FOREIGN PATENT DOCUMENTS

| | | | |
|---|---|---|---|
| CA | 2164370 | A1 | 6/1997 |
| CA | 2235048 | A1 | 10/1998 |
| CA | 2279473 | B1 | 3/2003 |
| JP | 62082213 | A * | 4/1987 |

* cited by examiner

COMPACT SILENCER

FIELD OF THE INVENTION

The present invention relates to silencers. More specifically, the present invention is concerned with wide absorption spectrum compact silencers.

BACKGROUND OF THE INVENTION

A silencer may be described as any section of a duct or pipe adapted to reduce the transmission of sound while allowing the free flow of a gas. Silencers can be broken into two fundamental groups: absorptive silencers and reactive silencers. Absorptive silencers include either fibrous or porous materials and depend on the absorptive properties of these materials to reduce noise. Absorptive silencers are most useful for noise control problems associated with high frequency spectra and their low frequency absorption increases with an increasing thickness of the absorbing material and with an increasing length of the silencer.

Reactive silencers contain no absorbing material but depend on the reflection or expansion of sound waves within a chamber to attenuate the sound. Peak attenuation occurs in the lower-frequency ranges, typically below 500 Kz. To provide a wide spectrum of attenuation, several chambers may be assembled in series.

Some silencers combine reactive and absorptive elements. However, these silencers typically are large and heavy and have some undesirable properties, such as a large resistance to motion or air within the silencer. Accordingly, difficulties in specifying a silencer for use in a particular situation are generally found when dealing with problems such as size, weight and aerodynamic pressure losses, among others, and not in providing a silencer with adequate acoustical performance.

Against this background, there exists a need in the industry to provide a novel and compact silencer.

OBJECTS OF THE INVENTION

An object of the present invention is therefore to provide an improved compact silencer that is capable of attenuating sound waves in a wide spectrum of frequencies.

It is another object of the invention to provide a silencer that through its structural arrangement of parts and dimensions relationship provides efficient attenuation of sound waves while being inexpensive to manufacture and versatile for mounting with any arrangement of fluid circulation.

SUMMARY OF THE INVENTION

The invention generally relates to a silencer for attenuating sound waves produced in a fluid that circulates through a conveying means. The silencer according to the invention comprises an expansion chamber and means allowing the expansion chamber to be in fluid communication with the conveying means, and to carry the sound waves through the chamber. A sound wave dissipater is provided with the expansion chamber and is arranged to absorb sound waves traveling through the expansion chamber. A resonator is operatively associated with the sound wave dissipater and is constructed and arranged to cause attenuation, and reflection of the sound waves back and forth towards the sound wave dissipater. The expansion chamber has a chamber : conveying means cross-sectional area ratio and chamber length characteristics allowing maximum transmission loss for a given frequency. Finally, means are provided to allow fluid containing attenuated sound waves to exit from the expansion chamber.

Advantageously, the silencer should be compact and light. Also, it should preferably attenuate sound waves having a wide spectrum of frequencies and provide only minimal resistance to a flow of gas there through.

BRIEF DESCRIPTION OF THE DRAWINGS

The invention will now be illustrated by means of the annexed drawings which are given by way of limitation and without limitation. In the drawings.

DESCRIPTION OF PREFERRED EMBODIMENTS

Figure 1:
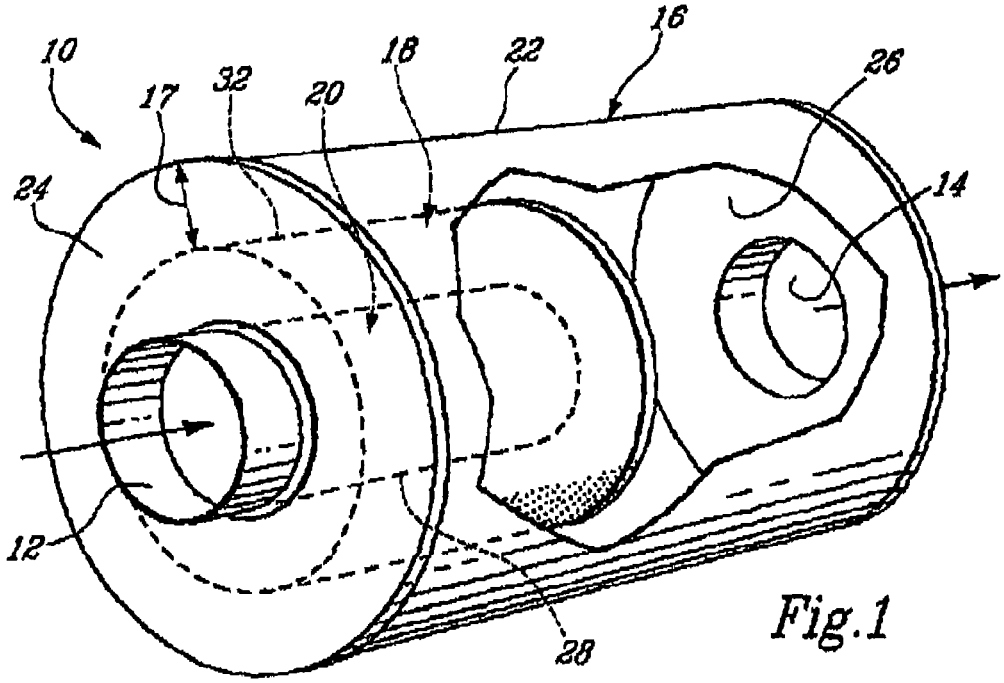
FIG. 1 is a perspective view of a silencer according to the invention including a dissipater and a resonator.

FIG. 1 shows a silencer 10 for attenuating sound waves. The silencer 10 includes an inlet 12, an outlet 14, an expansion chamber 16, a dissipater 18 and a resonator 20. The expansion chamber 16 is in fluid communication relationship with outlet 14. Dissipater 18 is provided within the expansion chamber 16 as shown. Resonator 20 is in a fluid communication relationship with inlet 12 and expansion chamber 16. Resonator 20 is further disposed within expansion chamber 16 and includes three baffles 30 (shown in FIG. 2) configured and sized to direct sound waves propagating within the resonator 20 towards dissipater 18.

Silencer 10 provides attenuation of sound waves at frequencies covering a wide spectrum, in a compact and light format. The expansion chamber 16 and the resonator 20 provide attenuation mainly at high frequencies, although they are intended to also attenuate some low frequencies.

The silencer 10 shown in FIG. 1 is one that is normally adapted for a Heating, Ventilation and Air Conditioning (HVAC) system. However, the reader skilled in the art will readily appreciate that silencers similar to silencer 10 could be used in many other applications such as, for example, attenuating sound waves in gas turbines, generators, vacuum cleaners and compressors, among others. In fact, silencer 10 can provide sound wave attenuation in any system wherein a fluid passes through a duct or a pipe.

The silencer 10 according to the invention is adapted for use in a ventilation system (not shown in the drawings) that is part, for example, of a HVAC system. To that effect, inlet 12 and outlet 14 can be of a diameter that is standard in the HVAC industry. Inlet 12 and outlet 14 can be soldered, or fixed through any other means, to the ventilation system. In a specific example of implementation, the silencer 10 attenuates sound waves in an air duct directing air towards one or more rooms in a building. However, it goes without saying that a silencer according to the invention may be used in conjunction with any fluid circulation system where noise is a problem.

Expansion chamber 16 includes a peripheral wall 22 and first and second end walls 24 and 26. Inlet 12 is provided in the first end wall 24 while outlet 14 is provided in the second end wall 26. While the expansion chamber 16 shown in FIG. 1 is substantially cylindrical, it could take any other suitable shape. For example, if a HVAC system includes pipes having a square cross-section, a silencer having a substantially square cross-section could be used advantageously.

Figure 2:
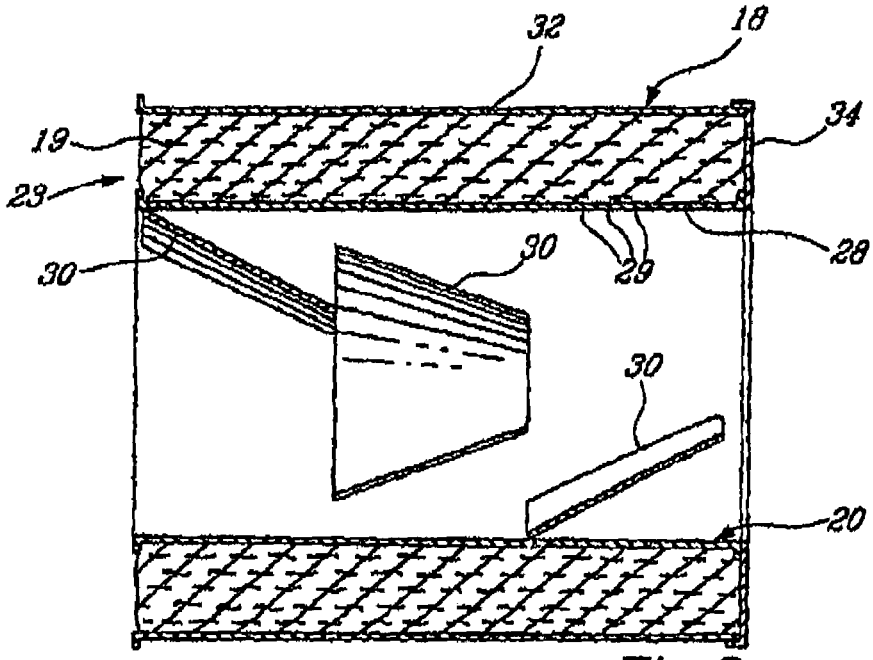
FIG. 2 is a side cross-sectional view of the dissipater and resonator of FIG. 1.

As shown in FIG. 2, resonator 20 includes a substantially cylindrical perforated inner wall 28 and a plurality of baffles 30, here three, that are provided within the resonator 20. Furthennore, the resonator 20 is surrounded at least in part by dissipater 18, which will be described in further detail herein below.

Perforated wall 28 is optionally of a diameter that is substantially equal to the diameter of inlet 12. Also, perforated wall 28 is in the continuity of inlet 12. The perforations 29 within wall 28 are sized to provide attenuation of sound waves within the resonator 20, as will be described herein below, while allowing high frequency sound waves to escape at least in part from resonator 20 towards dissipater 18.

It was found that a perforated wall 28 having perforations 29 covering at least 33% of the area of the perforated wall 28 provides advantageous sound absorption characteristics to the silencer 10. However, any other suitable type of perforations is within the scope of the invention.

In a specific example of implementation, the perforated wall 28 is of a length that is equal to the length required to provide maximal destructive interferences of sound waves present within resonator 20 and expansion chamber 16. This length is preferably equal to a fourth of a wave length of a sound wave to be attenuated. Accordingly, silencer 10, through expansion chamber 16 and resonator 20, operates optimally at a single frequency and at its harmonics. However, although silencer 10 provides an optimal attenuation of sound waves for only a few selected frequencies, other frequencies are also attenuated. This additional attenuation is, in part, caused by perforations 29 within perforated wall 28 and by partially destructive interferences of sound waves propagating substantially longitudinally within silencer 10.

The dimensions of expansion chamber 16 and of resonator 20 can be determined according to the intended use of the silencer using methods that are well known in the art.

Baffles 30 are fixed in known manner to perforated wall 28 and are preferably angled at an acute angle with respect to the perforated wall 28 as shown in FIG. 2. The baffles 30 are configured and sized to reflect sound waves that are propagated within the resonator 20, towards the dissipater 18. Resonator 20, shown in FIG. 2, includes three baffles 30. However, any number of baffles could be used in conjunction with the invention, as will be appreciated by one skilled in the art.

Figure 3:
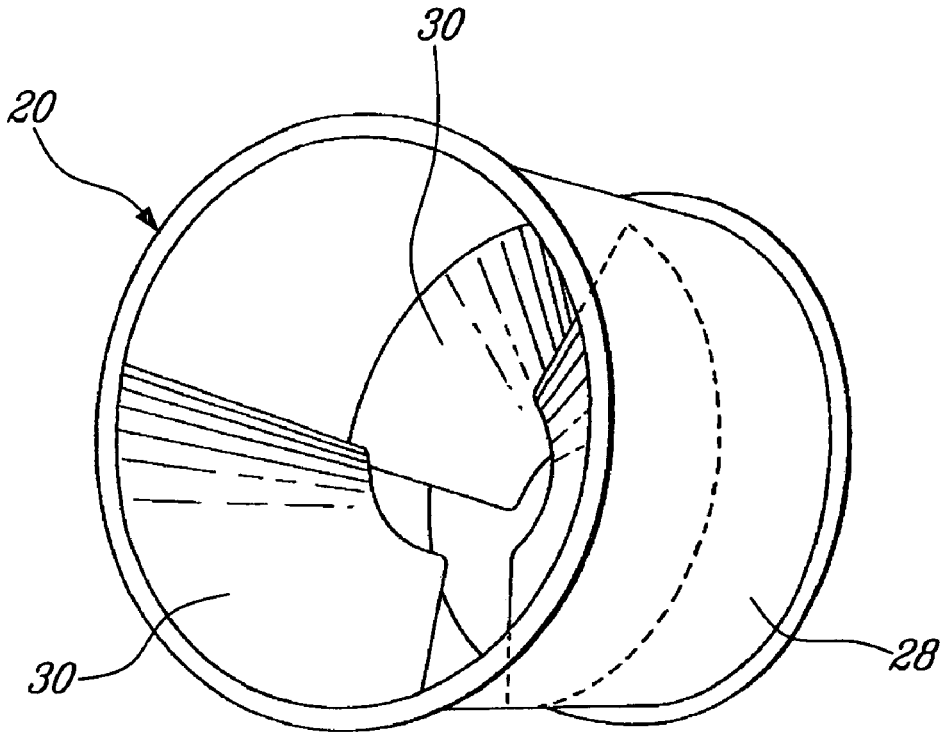
FIG. 3 is a perspective view of the resonator of FIG. 2.
Figure 4:
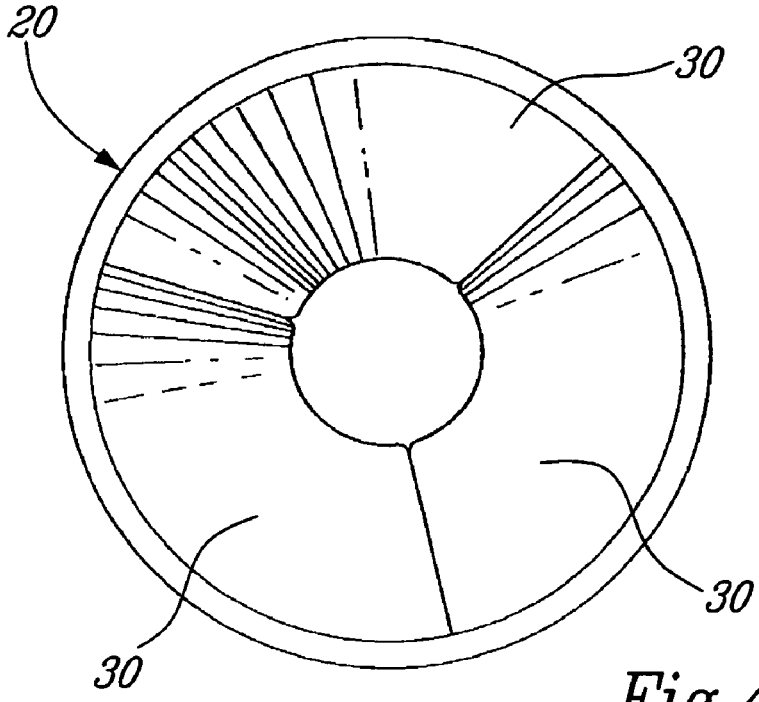
FIG. 4 is a front view of the resonator of FIG. 2.

In the illustrated embodiment, each baffle 30 includes a sector of a substantially frustoconical shell. However, other shapes of baffles are within the scope of the invention. As shown in FIGS. 3 and 4, the baffles 30 are placed, configured and sized such that when the resonator 20 is seen along a longitudinal axis, the baffles completely block to view an annular region within the resonator 20. Accordingly, the baffles 30 appear as a cone when seen from this point of view. Optionally, and as better shown in FIG. 3, baffles 30 adopt a substantially helicoidal configuration when mounted in the resonator. In addition, but non-essentially, the baffles 30 are oriented such that a narrow portion of each baffle 30 is further away from the inlet 12 than a wide portion of each baffle 30.

An efficient way to manufacture baffles 30 includes providing a frustum of a cone in a suitable material and cutting the frustum in a plurality of sectors, thereby forming the baffles 30.

Each baffle 30 includes a steel plate that may include optional perforations (not shown). However, it is within the scope of the invention to have baffles made of a different material, such as aluminum, among others. Also, each baffle 30 can optionally be covered in part or totally with a sound absorbing material of a type described in more details herein below with reference to dissipater 18. The sound absorbing material can in turn be surrounded by a perforated metal part.

Dissipater 18 includes an absorptive material 19 contained within an enclosure 23. Enclosure 23 is defined by the perforated wall 28, a surrounding wall 32 spacedly surrounding the perforated wall 28, an annular wall 34 and part of the first end wall 24. The surrounding wall 32 and the annular wall 34 can be perforated so as to allow sound waves to escape from the dissipater 18 into expansion chamber 16. In the embodiment shown in FIG. 1, a gap 17 is provided between the surrounding wall 32 and peripheral wall 22.

The absorptive material 19 can include felt, rock wool, fiberglass or any other suitable sound absorptive material. In a specific example of implementation, the absorptive material 19 has a density that can vary between two and four pounds per cubic foot.

The absorbing material is separated from the peripheral wall 22 by gap 17. As a result, sound waves exiting the absorptive material 19 can be reflected back into the absorptive material 19 through peripheral wall 22 after traveling in the air contained within the silencer 10. Accordingly, both the passage of sound waves within the air and multiple journeys through the absorptive material 19 add to an attenuation of high frequencies within the silencer 10 without requiring a large quantity of absorptive material 19, which lowers manufacturing cost and weight.

For example, a gap 17 having a width of substantially 4 inches greatly improves the performance of the absorptive material 19 in the resonator. However, any other suitable width for the gap can be used, as will be appreciated by one skilled in the art.

Optionally, a facing (not shown in the drawings) made of nylon, Mylar™, Tedlar™ or felt, for example, may be applied around the absorptive material 19 to provide protection against physical and/or chemical agents. Such facing can also improve the low-frequency absorption characteristics of the dissipater while reducing the possibilities that fragments of the absorptive material 19 become dislodged and are thereafter mixed with the air that circulates within silencer 10. This characteristic is advantageous in industries wherein dust contamination is undesirable.

In the illustrated embodiment, expansion chamber 16, resonator 20 and dissipater 18 include steel parts. However, the readers skilled in the art will readily appreciate that any other suitable material could be used in manufacturing expansion chamber 16, resonator 20 and dissipater 18.

In use, an air stream enters silencer 10 through inlet 12. The air stream in turn strikes baffles 30. The angle at which the air stream strikes the baffles and the geometry of the baffles create a pressure differential between air upstream of resonator 20 and air downstream of resonator 20. The disposition of the baffles 30, which tends to push air circulating within the resonator 20 around the baffles 30, along with the Bernoulli effect caused by the narrowing of the baffles 30 in a direction substantially identical to the general direction of the air flow within the resonator 20 help to limit the pressure differential. The air flow then exits from the resonator 20 within the expansion chamber 16. Since the expansion chamber 16 is filled with air, air is continuously expelled from silencer 10 through outlet 14.

With respect to the acoustical properties of silencer 10, it will be realized that the sound waves incoming at inlet 12 broadly have two different routes to travel through silencer 10 depending on their wavelength. Low frequency sound waves create standing waves within the resonator 20 and the expansion chamber 16. Since the expansion chamber 16 and the resonator 20 are preferably sized to provide attenuation at low frequencies, the standing waves created destructively interfere and cause attenuation in sound wave intensity at these low frequencies. Low frequency sound waves are also attenuated within the resonator 20 through a transmission loss caused by the frustoconical geometry of the baffles, which provide attenuation similarly to a single-piece frustum of a cone located within a cylindrical tube.

The high frequency sound waves are reflected by the baffles 30 toward dissipater 18. Accordingly, these high frequency sound waves are absorbed by the dissipative material contained within the dissipater 18. In addition, gap 17 between peripheral wall 22 and surrounding wall 32, along with the expansion of sound waves within the expansion chamber 16, further contribute to the attenuation of low and high frequencies within the silencer 10.

It has been found advantageous to provide baffles 30 having a high acoustic impedance at some of the frequencies to be attenuated by the silencer 10. Thus, a sound wave amplitude of sound waves reflected by the baffles 30 is relatively large and only a minimal portion of high frequency sound waves reaches outlet 14. In this case, because of the frustoconical geometry of baffles 30, the sound waves are reflected in many directions within the silencer 10, which creates many different apparent gap thicknesses in the reflected sound waves. As a result, low frequencies are also absorbed more efficiently than in prior art silencers.

It has also been found that sound wave attenuation by the silencer 10 is not a linear function of the length of the resonator 16 as absorption is very large with only a few baffles in the resonator 16. Accordingly, silencer 10 can be very compact while having good sound attenuation characteristics.

However, it was realized that it is essential to provide the expansion chamber with critical dimension characteristics. For example, the ratio between the cross-sectional area of the expansion chamber and the cross-sectional area of the conveying means such as that at the inlet, and the length of the chamber should be such that these parameters allow a maximum transmission loss for a given frequency. More specifically, transmission loss is achieved when TL is at a maximum value. For this purpose, TL is represented by the following formula:

$$TL=10\log[1+\tfrac{1}{4}(m-1/m)^2\sin^2 kl]db$$

wherein

TL represents transmission loss;

M=cross-sectional area of chamber/cross-sectional area of fluid conveying means;

k=wave number=$2\pi/\lambda$;

l=chamber length;

$\lambda$=wave length of sound at temperature of gas in the expansion chamber.

In an alternative embodiment of silencer 10, the resonator 20 and the dissipater 18 are located outside of and in series with the expansion chamber 16.

Although the present invention has been described hereinabove by way of preferred embodiments thereof, it is obvious that it can be modified, without departing from the spirit and scope of the invention as defined in the appended claims.

What is claimed is:

1. A silencer for attenuating sound waves produced in a fluid that circulates through a fluid conveying means, said silencer comprising an expansion chamber formed with an outer peripheral wall and first and second end walls, said first end wall being provided with an inlet opening into said expansion chamber, said second end wall being provided with an outlet opening allowing said fluid to exit from said expansion chamber, said expansion chamber being in fluid communication with said fluid conveying means and adapated to carry said sound waves therethrough;

a sound wave dissipater comprising a sound absorbing tubular member longitudinally disposed within said expansion chamber and arranged to absorb sound waves traveling through said expansion chamber, and having a central longitudinal void therethrough, said sound absorbing tubular member comprising an inner cylindrical wall, an outer surrounding cylindrical wall spaced from said inner cylindrical wall, inner ends of said inner cylindrical and outer surrounding walls contacting said first end wall, and outer ends thereof being closed by an annular wall, to define an enclosure, and sound wave absorbing means disposed in said enclosure, at least one of said inner inner cylindrical wall, said outer surrounding wall and said annular wall being provided with perforations sized to attenuate high frequency sound waves, and to allow them to be at least partially absorbed by said sound wave absorbing means;

a resonator operatively associated with said sound wave dissipater and disposed in said central longitudinal void, said resonator comprising a plurality of baffles fixed to said inner cylindrical walls, and mounted at an acute angle with respect to said inner cylindrical wall, each baffle being shaped as a sector of a substantially frustoconical shell, said baffles being longitudinally spaced relative to one another and being helicoidally distributed along said inner cylindrical wall, in a manner that they completely block to view an annular region within said resonator, said resonator being constructed and arranged to cause attenuation, and reflection of said sound waves back and forth towards said sound wave dissipater.

2. The silencer according to claim 1, wherein said maximum transmission loss for said expansion chamber is achieved when TL is at a maximum value, said TL being represented by the following formula:

$$TL=10\log[1+\tfrac{1}{4}(m-1/m)^2\sin^2 kl]db$$

wherein

TL represents transmission loss;

M=cross-sectional area of chamber/cross-sectional area of fluid conveying means;

k=wave number=$2\pi/\lambda$;

l=chamber length;

$\lambda$=wave length of sound at temperature of gas in expansion chamber.

3. The silencer according to claim 1, wherein said resonator comprises at least three frustoconically shaped baffles.

4. The silencer according to claim 1, wherein said perforations cover at least 33% of the area of the inner cylindrical wall.

5. The silencer according to claim 4, wherein the perforated inner cylindrical wall has a length that is equal to one fourth of the wave length of the sound wave to be attenuated.

6. The silencer according to claim 1, wherein each baffle has a narrow end partition and a wider end partition, said narrow end partition being further away from said inlet opening than said wider end portion.

7. The silencer according to claim 1, wherein said baffles are made of steel or aluminum plates.

8. The silencer according to claim 7, wherein said steel or aluminum plates include perforations.

9. The silencer according to claim 7, wherein said baffles are covered with a sound absorbing material.

10. The silencer according to claim 9, wherein said absorbing material is surrounded by a perforated metal part.

11. The silencer according to claim 1, wherein the sound wave dissipater is dimensioned so as to provide an annular gap between said outer peripheral wail and said outer surrounding cylindrical wall through which said fluid loaded with sound waves can travel, said annular gap thereby improving performance of said absorbing means.

* * * * *